US006526763B2

(12) United States Patent
Tchougounov et al.

(10) Patent No.: US 6,526,763 B2
(45) Date of Patent: Mar. 4, 2003

(54) ICE MAKER AND METHOD OF MAKING ICE

(75) Inventors: Andrei Tchougounov, Ligonier, IN (US); Robert G. Cox, Goshen, IN (US); Terry L Hygema, North Webster, IN (US); Steven M. Nimtz, Cromwell, IN (US)

(73) Assignee: Dekko Heating Technologies, Inc., North Webster, IN (US)

( * ) Notice: Subject to any disclaimer, the term of this patent is extended or adjusted under 35 U.S.C. 154(b) by 0 days.

(21) Appl. No.: 09/964,243

(22) Filed: Sep. 26, 2001

(65) Prior Publication Data

US 2002/0007638 A1 Jan. 24, 2002

Related U.S. Application Data

(63) Continuation-in-part of application No. 09/748,411, filed on Dec. 26, 2000, which is a continuation-in-part of application No. 09/499,011, filed on Feb. 4, 2000, now Pat. No. 6,223,550, which is a continuation-in-part of application No. 09/285,283, filed on Apr. 2, 1999, now Pat. No. 6,082,121.

(51) Int. Cl.[7] ..... F25C 1/12
(52) U.S. Cl. ..... 62/71; 62/135; 62/208
(58) Field of Search ..... 62/71, 135, 208, 62/209, 213

(56) References Cited

U.S. PATENT DOCUMENTS

| | | | | |
|---|---|---|---|---|
| 948,131 A | | 2/1910 | Bull | 62/356 |
| 1,963,842 A | | 6/1934 | Gay | 62/105 |
| 2,775,101 A | | 12/1956 | Hanson | 62/356 |
| 3,196,624 A | | 7/1965 | Reynolds | 62/71 |
| 3,274,792 A | | 9/1966 | Weil et al. | 62/354 |
| 3,306,072 A | * | 2/1967 | Dahlgren et al. | 62/135 |
| 3,654,772 A | | 4/1972 | Curry, III | 62/353 |
| 3,678,701 A | | 7/1972 | Powell et al. | 62/353 |
| 3,708,992 A | | 1/1973 | Clearman et al. | 62/71 |
| 3,850,008 A | * | 11/1974 | Frazier | 62/353 |
| 3,855,812 A | * | 12/1974 | Linstromberg | 62/135 |
| 3,896,631 A | | 7/1975 | Morrison | 62/71 |
| 3,984,996 A | | 10/1976 | Bright | 62/353 |
| 4,003,214 A | | 1/1977 | Schumacher | 62/340 |
| 4,183,222 A | | 1/1980 | Swanson | 62/71 |
| 4,355,522 A | | 10/1982 | Gorski et al. | 62/340 |
| 4,429,543 A | | 2/1984 | Fischer | 62/347 |
| 4,732,006 A | | 3/1988 | Fischer | 62/71 |
| 4,901,539 A | | 2/1990 | Garber et al. | 62/356 |
| 4,959,967 A | * | 10/1990 | Lanzani | 62/138 |
| 5,167,132 A | | 12/1992 | Meier | 62/356 |
| 5,778,686 A | * | 7/1998 | Choi | 62/135 |

FOREIGN PATENT DOCUMENTS

| | | | |
|---|---|---|---|
| DE | 351706 | 3/1921 | 62/356 |

* cited by examiner

*Primary Examiner*—William E. Tapolcai
(74) *Attorney, Agent, or Firm*—Taylor & Aust, P.C.

(57) ABSTRACT

A method of making ice in an automatic ice maker includes the steps of: providing a mold including one cavity; filling the at least one mold cavity at least partially with water; providing an ice removal device at least partly within the at least one mold cavity; coupling a mechanical drive with the ice removal device; coupling a controller with the drive; measuring a temperature of the mold; measuring an ambient temperature associated with the mold; and controlling operation of the drive using the controller, dependent upon the measured temperature of the mold and the measured ambient pressure.

19 Claims, 3 Drawing Sheets

ICE MAKER AND METHOD OF MAKING ICE

CROSS REFERENCE TO RELATED APPLICATIONS

This is a continuation-in-part of U.S. patent application Ser. No. 09/748,411, entitled "ICE MAKER AND METHOD OF MAKING ICE", filed Dec. 26, 2000, which is a continuation-in-part of U.S. patent application Ser. No. 09/499,011, entitled "ICE MAKER", filed Feb. 4, 2000 now U.S. Pat. No. 6,223,550, which is a continuation-in-part of U.S patent application Ser. No. 09/285,283, entitled "ICE MAKER", filed Apr. 2, 1999, now U.S. Pat. No. 6,082,121.

BACKGROUND OF THE INVENTION

1. Field of the Invention

The present invention relates to freezers, and, more particularly, to ice makers within freezers.

2. Description of the Related Art

The freezer portion of a refrigeration/freezer appliance often includes an ice cube maker which dispenses the ice cubes into a dispenser tray. A mold has a series of cavities, each of which is filled with water. The air surrounding the mold is cooled to a temperature below freezing so that each cavity forms an individual ice cube. As the water freezes, the ice cubes become bonded to the inner surfaces of the mold cavities.

In order to remove an ice cube from its mold cavity, it is first necessary to break the bond that forms during the freezing process between the ice cube and the inner surface of the mold cavity. In order to break the bond, it is known to heat the mold cavity, thereby melting the ice contacting the mold cavity on the outermost portion of the cube. The ice cube can then be scooped out or otherwise mechanically removed from the mold cavity and placed in the dispenser tray. A problem is that, since the mold cavity is heated and must be cooled down again, the time required to freeze the water is lengthened.

Another problem is that the heating of the mold increases the operational costs of the ice maker by consuming electrical power. Further, this heating must be offset with additional refrigeration in order to maintain a freezing ambient temperature, thereby consuming additional power. This is especially troublesome in view of government mandates which require freezers to increase their efficiency.

Yet another problem is that, since the mold cavity is heated, the water at the top, middle of the mold cavity freezes first and the freezing continues in outward directions. In this freezing process, the boundary between the ice and the water tends to push impurities to the outside of the cube. Thus, the impurities become highly visible on the outside of the cube and cause the cube to have an unappealing appearance. Also, the impurities tend to plate out or build up on the mold wall, thereby making ice cube removal more difficult.

A further problem is that vaporization of the water in the mold cavities causes frost to form on the walls of the freezer. More particularly, in a phenomenon termed "vapor flashing", vaporization occurs during the melting of the bond between the ice and the mold cavity. Moreover, vaporization adds to the latent load or the water removal load of the refrigerator.

Yet another problem is that the ice cube must be substantially completely frozen before it is capable of withstanding the stresses imparted by the melting and removal processes. This limits the throughput capacity of the ice maker.

What is needed in the art is an ice maker which does not require heat in order to remove ice cubes from their cavities, has an increased throughput capacity, allows less evaporation of water within the freezer, eases the separation of the ice cubes from the auger and does not push impurities to the outer surfaces of the ice cubes.

SUMMARY OF THE INVENTION

The present invention provides a control system and corresponding method of operation which allows ice cubes to be automatically harvested in an efficient manner.

The invention comprises, in one form thereof a method of making ice in an automatic ice maker, including the steps of: providing a mold including at least one cavity; filling the at least one mold cavity at least partially with water, providing an ice removal device at least partly within the at least one mold cavity; coupling a mechanical drive with the ice removal device; coupling a controller with the drive; measuring a temperature of the mold; measuring an ambient temperature associated with the mold; and controlling operation of the drive using the controller, dependent upon the measured temperature of the mold and the measured ambient temperature.

The invention comprises, in another form thereof, an ice maker including a mold with at least one cavity for containing water therein for freezing into ice. A mold temperature sensor is positioned in association with a mold and provides an output signal indicative of a temperature of the mold. An ambient temperature sensor provides output signal indicative of an ambient temperature associated with the mold. An ice removal device is at least partly positioned within the at least one mold cavity. The mechanical drive drives the ice removal device. A controller is coupled with each of the mold temperature sensor, the ambient temperature sensor and the drive. The controller controls operation of the drive dependent upon the output signal from the mold temperature sensor and the output signal from the ambient temperature sensor.

An advantage of the present invention is that ice cubes may automatically be harvested depending upon the temperature of the mold, thereby increasing the throughput rate of the ice maker.

Another advantage is that the time period necessary for freezing the ice may be calculated without continuously sensing and memorizing the temperature of the mold.

Yet another advantage is that the time period necessary for freezing the ice may be adjusted automatically based upon changing environmental conditions within the freezer which affect the temperature gradient of the freezing. That provides for better cube quality: no soft cubes, no hollow cubes, no broken cubes.

A further advantage is that filling of the mold cavity does not occur until the temperature of the mold has decreased to a point where freezing may begin occurring after filling, so no double fills will occur.

Another advantage is that a frozen or blocked fill tube may be sensed and heat applied thereto for the purpose of clearing the fill tube.

BRIEF DESCRIPTION OF THE DRAWINGS

The above-mentioned and other features and advantages of this invention, and the manner of attaining them, will become more apparent and the invention;will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
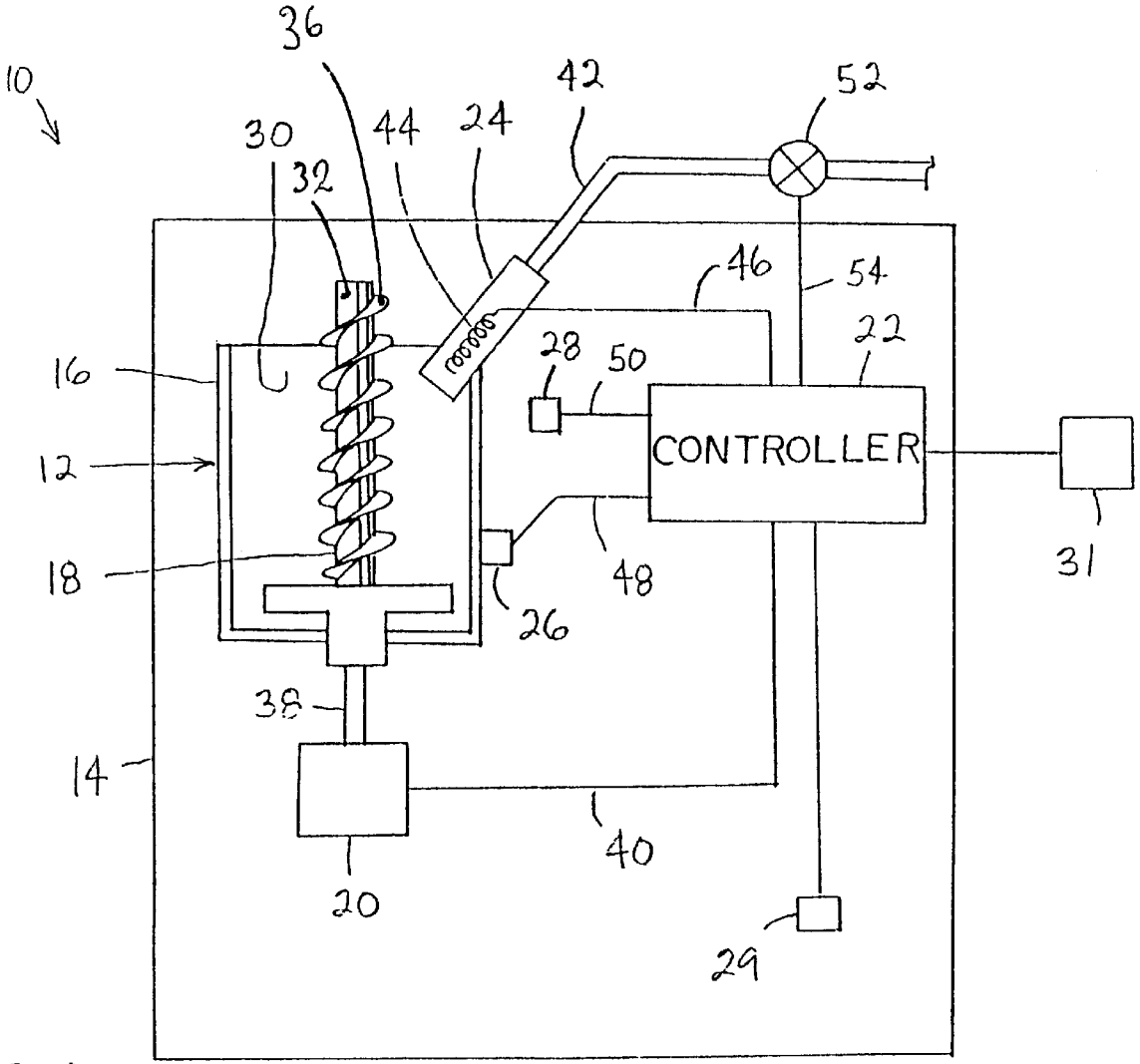
FIG. 1 is a schematic illustration of a freezer including an embodiment of an ice maker of the present invention.

Referring now to the drawings, and more particularly to FIG. 1, there is shown an embodiment of a freezer 10 including an ice maker 12 disposed within a freezer unit 14. Freezer 14 may be, e.g., a side-by-side arranged or vertically stacked freezer unit in a household freezer appliance.

Ice maker 12 generally includes a mold 16, an auger 18, a mechanical drive 20, a controller 22, a fill tube 24, a mold temperature sensor 26 and an ambient temperature sensor 28. Mold 16 includes at least one mold cavity 30 for containing water therein for freezing into ice. In the embodiment shown, mold 16 includes a single mold cavity 30 with interior walls having a slight draft to allow the ice to be more easily removed therefrom. Auger 18 includes an auger shaft 32 about which a continuous flighting 36 extends from one end to the other. Auger 18 is tapered in a discharge direction to allow easier decoupling from the at least partially frozen ice cube which is formed within mold 16. For more details of a mold and tapered auger which may be utilized with ice maker 12 of the present invention, reference is hereby made by to U.S. patent application Ser. No. 09/499,011, entitled "Ice Maker", which is assigned to the assignee of the present invention and incorporated herein by reference. Drive 20 rotatably drives auger 18 within mold 16. In the embodiment shown, drive 20 is in the form of an electric motor, such as an alternating current or direct current motor, having an output shaft 38 which is coupled with and drives auger 18. Drive 20 is electrically coupled with controller 22 via line 40.

Fill tube 24 is coupled with a water line 42 and receives water from a water source (not shown), such as a common pressurized household water supply line. Fill tube 24 selectively receives water such as by using a control valve 52 for supplying water to cavity 30 within mold 16. Control valve 52 is coupled with controller 22 via line 54. Fill tube 24 includes a heater 44 therein which is selectively energized to melt any accumulation of ice which may build up in fill tube 24 during operation. In the embodiment shown, heater 44 is in the form of an electrical wire which is over molded within fill tube 24, and electric controller 22 via line 46. For more details for a heated fill tube 24 which may be utilized with the present invention, reference is hereby made to U.S patent application Ser. No. 09/130,180, entitled "Heater Assembly For a Fluid Conduit With an Internal Heater", which is assigned to the assignee of the present invention and incorporated herein by reference.

Mold temperature sensor 26 is positioned in association with mold 16 to sense a temperature of mold 16. In the embodiment shown, mold temperature sensor 26 is embedded within or carried by a sidewall of mold 16 to thereby sense a temperature of the sidewall and provide an output signal to controller 22 via line 48. Ambient temperature sensor 28 is positioned in association with mold 16 and provides an output signal indicative of the sensed ambient temperature. Ambient temperature sensor 28 may be mounted to suitable structure within freezer 14, and is preferably mounted to ice maker 12. For example, ice maker 12 may include a mounting flange for mounting to a wall within freezer 14, and ambient temperature sensor 28 may be mounted to the flange of ice maker 12. Other suitable mounting locations on ice maker 12 which are not in contact with mold 16 are also possible.

Sensor 29 is used to detect whether or not ice is present within an ice holding tray or bin in freezer unit 14. Sensor 29 provides an output signal to controller 22 indicative of whether the ice tray is already full.

Compressor 31 is also coupled with controller 22 and provides an output signal to controller 22. In particular compressor 31 provides a signal to controller 22 indicating whether compressor 31 is running or not running.

Controller 22 is used to selectively accuate drive 20, heater 44 and/or valve 52. The control of drive 20, heater 44 and valve 52 is at least in part dependent upon one or more output signals which are outputted from first temperature sensor 26, second temperature sensor 28 and/or sensor 29 to controller 22.

Figure 2A:
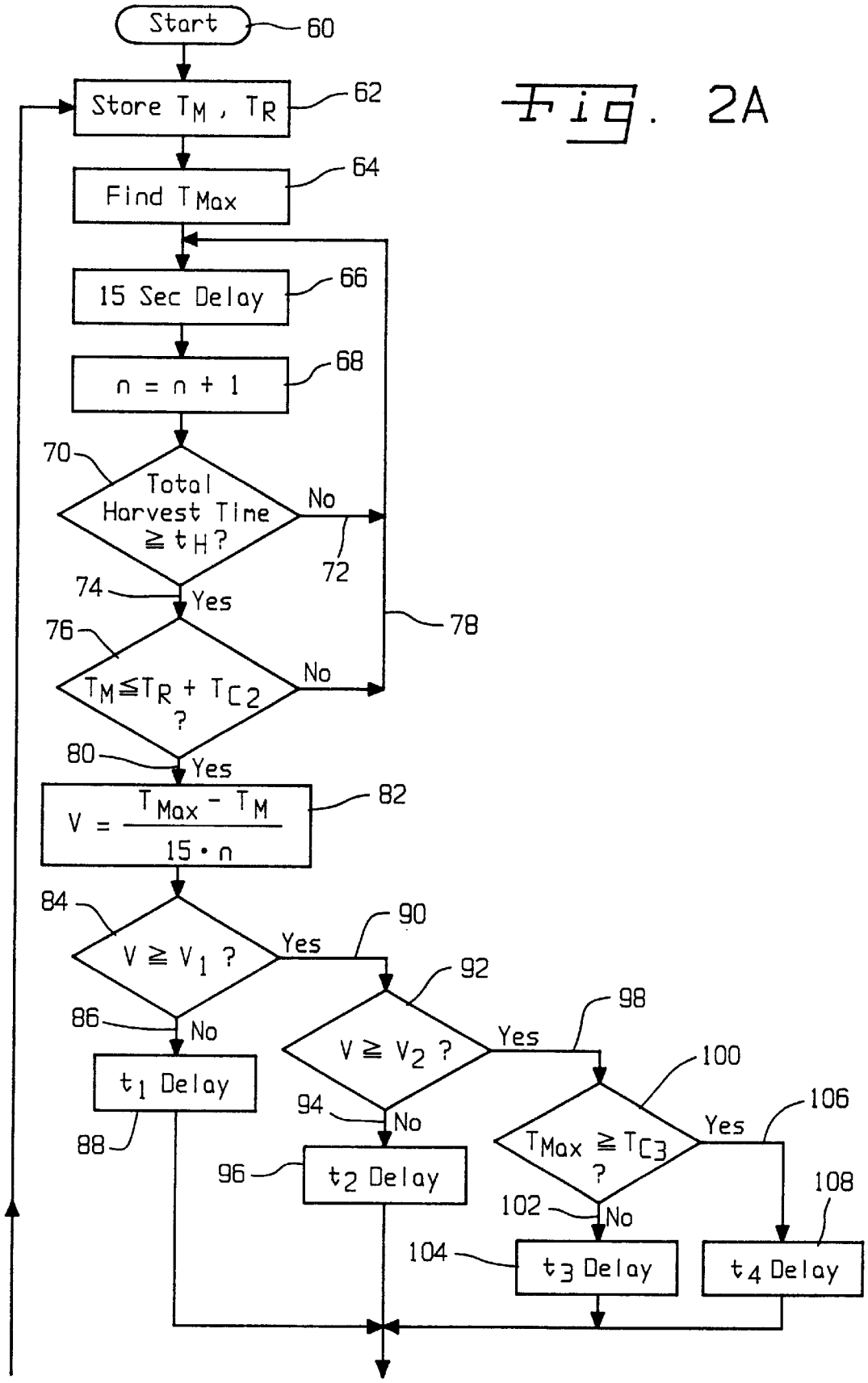
FIG. 2 is a flow chart of a method of making ice of the present invention.
Figure 2B:
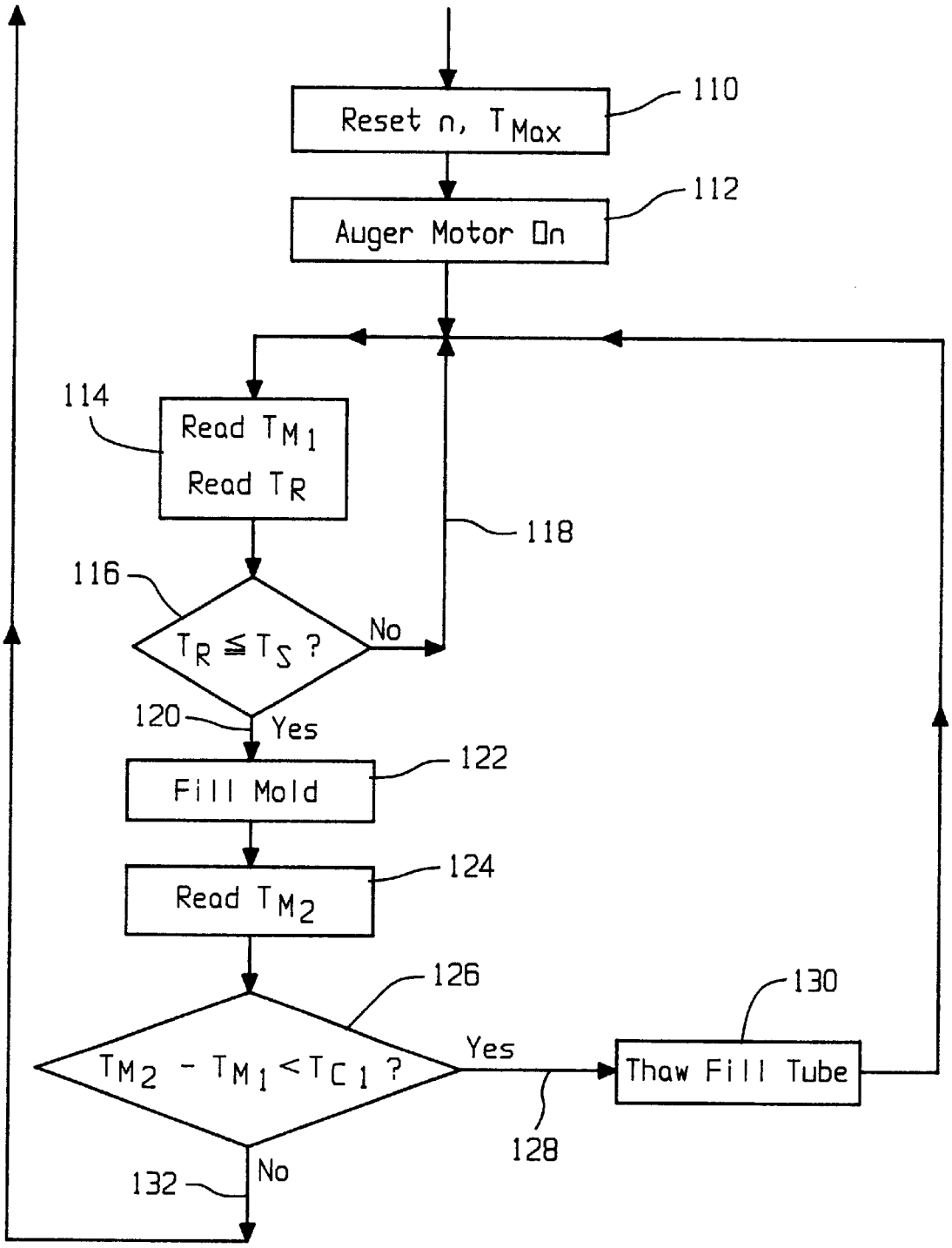

Referring now to FIG. 2, there is shown a flow chart illustrating an embodiment of a method of the present invention for making ice in automatic ice maker 12 shown in FIG. 1. Ice maker 12 generally freezes ice cubes in a batch manner such that ice cubes are sequentially frozen and discharged into a suitable holding tray (not shown). The method described hereinafter corresponds to the logic processes for forming a single ice cube within ice maker 12. It will be appreciated that the method continues in a looped fashion for making additional ice cubes within ice maker 12.

Moreover, the embodiment of the present invention for making ice cubes described hereinafter is assumed to be carried out in software within suitable electronics, and thus may be easily implemented by a person of ordinary skill in the art. It is to be appreciated, however, that the embodiment of the method of the present invention described hereinafter may be carried out in software, firmware and/or hardware, depending upon the particular application.

After start 60 of the control logic flow chart shown in FIG. 2, a mold temperature Tm and initial ambient temperature Tr are stored in a memory device (block 62). Mold temperature sensor 26 outputs a signal via line 48 to controller 22 corresponding to mold temperature Tm; and ambient temperature sensor 28 outputs a signal via line 50 to controller 22 corresponding to initial ambient temperature Tr. Mold temperature Tm and initial ambient temperature Tr may be stored in a non-volatile memory to form a history of stored temperatures over time.

At block 64, a maximum mold temperature T max is determined using mold temperature sensor 26. The maximum mold temperature T max corresponds to the maximum temperature reached by mold 16 after being filled with water as a result of thermal inertia. Mold 16 is generally at a temperature corresponding the internal temperature within freezer unit 14 prior to an initial fill cycle (i.e., approximately the same as the ambient temperature sensed by ambient temperature sensor 28). The water which is injected into mold 16 is at an elevated temperature (e.g, 60° F.). After mold 30 is filled with water from fill tube 24, the elevated temperature of the water within mold cavity 30 causes the temperature of mold 16 to increase according to the corresponding temperature gradient curve. At some point in time, however, the temperature of mold 16 reaches a maximum level T max and then again descends as a result of the colder temperature of the air within freezer unit 14. Suitable control logic, such as that found in co-pending parent application Ser. No. 09/748,411 can be used to detect the maximum temperature T max of mold 16 after being filled with water.

Blocks 66, 68, 70 and 72 basically define a wait state during which heat transfer is allowed to occur for freezing the water into ice within mold cavity 30. At block 66, a delay interval of fifteen seconds, or other suitable delay time period, occurs. A counter n, initially set to zero, is incremented by one at block 68. A total harvest time consisting of the summation of the delay intervals is compared with a minimum time constant Th (block 70). Minimum time constant Th corresponds to an empirically determined value of a minimum amount of time necessary for freezing of the water to occur. If the total harvest time is less than the minimum time constant Th (line 72), then control loops back to the input side of block 66 and another delay interval occurs. On the other hand, if the total harvest time is greater than or equal to the minimum time constant Th (line 74), then a determination is made as to whether the temperature of the mold is approximately the same as the ambient temperature sensed by ambient temperature sensor 28 within freezer 14.

More particularly, the temperature of the mold increases above the internal ambient temperature within freezer 14 when water is injected into mold cavity 30. As the water freezes, the temperature of mold 16 decreases and again approaches the internal ambient temperature within freezer 14. Constant Tc2 is selected empirically to slightly raise the comparison value of the internal mold temperature Tr in decision block 76. Since the mold temperature and the internal ambient temperature asymptotically approach each other over time after a fill cycle, it has been found necessary to slightly adjust the ambient temperature Tr by the offset constant Tc2 for the proper determination of whether freezing has occurred. If the mold temperature Tm is greater than the sum of the ambient temperature Tr and the constant Tc2 (line 78), control loops back to the input side of block 66 as shown. On the other hand, if the mold temperature Tm is less than or equal to the sum of the ambient temperature Tr and the constant Tc2 (line 80), control passes to the next group 82-108 for the purpose of determining an additional delay period during which freezing occurs prior to discharging an ice cube using drive 20 controlled by controller 22.

To wit, at block 82 the slope V (represented by the temperature fall in degrees per unit of time, e.g., seconds) is calculated using the mathematical expression:

$$T\ \max - Tm/15 \times n$$

Where,

Tm is the sensed current mold temperature using mold temperature sensor 26, and the quotient 15×n represents in this example the total time for freezing to occur thus far within mold cavity 30. Of course, the number 15 will vary if the delay interval in block 66 is selected differently. The slope V represents the rate at which freezing occurred within mold cavity 30. If freezing occurs too rapidly, such as with a high value of the slope V, the outside of an ice cube may freeze while the interior may still remain in a liquid state as water.

At decision block 84, slope V of the temperature gradient is compared with a predetermined constant V1. If the slope V is less than the constant V1 (line 86), then an additional delay T1 occurs to ensure that the water is frozen into ice. On the other hand, if the slope V is greater than or equal to the predetermined constant V1 (line 90), then the slope V is compared to a further predetermined constant V2. The constant V2 is selected with a value which is greater than the constant V1. If the slope V of the temperature gradient is less than the predetermined constant V2 (line 94), then an additional delay time T2 occurs to ensure that the water is frozen into ice.

On the other hand, if the slope V is greater than or equal to the predetermined constant V2 (line 98), then a determination is made as to whether the maximum mold temperature T max is greater than or equal to a predetermined constant Tc3 (decision block 100). If the maximum mold temperature T max is less than the constant Tc3 (line 102), then an additional time delay T3 occurs to ensure that the water freezes into ice. The value of the time delay T3 is greater than time delay T2, which in turn is greater than time delay T1.

On the other hand, if the maximum mold temperature T max is greater than or equal to the constant T3, than this in general terms means that the mold warmed too much during the fill cycle and it is necessary to delay for a longer period to ensure that the interior of the ice cube freezes adequately. Thus, if the maximum mold temperature T max is greater than or equal to the constant Tc3 (line 106), then an additional time delay T4 occurs to ensure that the water freezes into ice. The value of the additional time delay T4 is greater than the value of time delay T3.

The output from each of blocks 88, 96, 104 and 108, each with a different time delay period, T1, T2, T3 and T4, respectively, are inputted in a parallel manner to block 110, wherein the value of counter N is reset to zero and the value of the maximum mold temperature T max is set to zero. At block 112, controller 22 energizes drive 20 to discharge the ice cube from mold cavity 30 using auger 18.

Blocks 114 through 130 relate to the filling cycle of mold cavity 30 within mold 16. Blocks 114 and 116 generally relate to determining whether the temperature of mold 16 has decreased to an extent allowing adequate freezing of the water to occur during the fill cycle. In block 114, a current mold temperature Tm1 and an ambient temperature Tr are sensed using mold temperature sensor 26 and ambient temperature sensor 28, respectively. The ambient temperature Tr is compared with a constant Ts which is selected to be less than the freezing temperature of water. If the ambient temperature Tr is greater than the constant Ts (line 118), then a wait state occurs to the input side of block 114 while the mold continues to cool in freezer 14. On the other hand, if the value of the ambient temperature Tr is less than or equal to the constant Ts (line 120), then the mold has cooled sufficiently and water is injected into mold cavity 30 using fill tube 34 (block 122).

After being filled with water, the temperature Tm2 of mold 16 is again sensed using mold temperature sensor 26 (block 124). The difference of the mold temperature Tm2 after filling and the mold temperature Tm1 immediately prior to filling are compared with a predetermined constant Tc1 (decision block 126). If the difference of the mold temperature Tm2 after filling minus the mold temperature Tm1 immediately prior to filling is less than the constant Tc1 (line 128), this means that the fill tube 24 has become frozen and water did not enter mold cavity 30 during the fill process of block 122. Thus, heat is applied to fill tube 24 for thawing ice within fill tube 24 (block 30). On the other hand, if the difference of the mold temperature Tm2 immediately after filling minus the mold temperature Tm1 immediately prior to filling is greater than or equal to the constant Tc1 (line 132), then control loops back to the input of block 62 at the top of the control logic flow chart.

From the foregoing description of an embodiment of the method of the present invention for automatically making ice cubes, it will be appreciated that different logic steps may be implemented and/or interchanged and still effect the methodology of the present invention. The control logic effectively determines the amount of time necessary for adequate freezing of an ice cube, adjusts the time necessary using certain input parameters, and ensures that proper filling of water into the ice mold cavity occurs. The structure as well as the method of the present invention therefore combine to provide optimum harvest efficiency with minimum mechanical and electrical control hardware.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ice maker, comprising:

a mold including at least one cavity for containing water therein for freezing into ice;

a mold temperature sensor positioned in association with said mold and providing an output signal indicative of a temperature of said mold;

an ambient temperature sensor providing an output signal indicative of an ambient temperature associated with said mold;

an ice removal device at least partly within said at least one mold cavity;

a mechanical drive for driving said ice removal device; and a controller coupled with each of said mold temperature sensor, said ambient temperature sensor and said drive, said controller controlling operation of said drive dependent upon said output signal from said mold temperature sensor, said output signal from said ambient temperature sensor and a calculated slope of a temperature gradient.

2. A freezer, comprising:

a freezer unit including an ice maker, said ice maker comprising:

a mold including at least one cavity for containing water therein for freezing into ice;

a mold temperature sensor positioned in association with said mold and providing an output signal indicative of a temperature of said mold;

an ambient temperature sensor providing an output signal indicative of an ambient temperature associated with said mold;

an ice removal device at least partly within said at least one mold cavity;

a mechanical drive for driving said ice removal device; and a controller coupled with each of said mold temperature sensor, said ambient temperature sensor and said drive, said controller controlling operation of said drive dependent upon said output signal from said mold temperature sensor, said output signal from said ambient temperature sensor and a calculated slope of a temperature gradient.

3. A method of making ice in an automatic ice maker, comprising the steps of:

providing a mold including at least one cavity;

filling said at least one mold cavity at least partially with water;

providing an ice removal device at least partly within said at least one mold cavity;

coupling a mechanical drive with said ice removal device;

coupling a controller with said drive;

measuring a temperature of said mold;

measuring an ambient temperature associated with said mold; and controlling operation of said drive using said controller, dependent upon said measured temperature of said mold, said measured ambient temperature and a calculated slope of a temperature gradient.

4. The method of claim 3, including the steps of:

setting an initial ambient temperature Tr using said measured ambient temperature; and determining a maximum mold temperature T max.

5. The method of claim 3, including the step of storing said mold temperature and said initial ambient temperature Tr in a memory device.

6. A method of making ice in an automatic ice maker, comprising the steps of:

providing a mold including at least one cavity;

filling said at least one mold cavity at least partially with water;

providing an ice removal device at least partly within said at least one mold cavity;

coupling a mechanical drive with said ice removal device;

coupling a controller with said drive;

measuring a temperature of said mold;

measuring an ambient temperature associated with said mold;

setting a delay interval;

setting a minimum time constant Th;

pausing a number of said delay intervals, until a total time dependent upon said number of delay intervals is greater than said minimum time constant Th; and controlling operation of said drive using said controller, dependent upon said measured temperature of said mold and said measured ambient temperature.

7. The method of claim 6, wherein said delay interval is less than said minimum time constant Th, and including the steps of:

setting a counter n;

incrementing said counter n corresponding to said number of delay intervals.

8. The method of claim 6, including the steps of:

after said pausing step, sensing a current temperature Tm of said mold;

comparing said current mold temperature Tm with said initial ambient temperature Tr and a constant Tc2 using the mathematical expression:

$$Tm \leqq Tr + Tc2.$$

9. A method of making ice in an automatic ice maker, comprising the steps of:

providing a mold including at least one cavity;

filling said at least one mold cavity at least partially with water;

providing an ice removal device at least partly within said at least one mold cavity;

coupling a mechanical drive with said ice removal device;

coupling a controller with said drive;

measuring a temperature of said mold;

measuring an ambient temperature associated with said mold;

calculating a slope of a temperature gradient of said mold temperature over time, delaying discharge from said mold cavity dependent upon said calculated slope; and controlling operation of said drive using said controller, dependent upon said measured temperature of said mold and said measured ambient temperature.

10. The method of claim 9, said calculating step being carried out using the mathematical expression:

$$V=(T\ \max-Tm)/\text{total delay}$$

where V=slope of temperature gradient.

11. The method of claim 10, including the step of comparing said slope V with a predetermined constant V1 and delaying said discharge by a time t1 if said slope V is less than said constant V1.

12. The method of claim 11, wherein if said slope V is greater than or equal to said constant V1, then comparing said slope V with a predetermined constant V2 and delaying said discharge by a time t2 if said slope V is less than said constant V2, said constant V2 being greater than said constant V1 and said time t2 being greater than said time t1.

13. The method of claim 12, wherein if said slope V is greater than or equal to said constant V2, then comparing said maximum mold temperature T max with a predetermined constant Tc3 and delaying said discharge by a time t3 if said maximum mold temperature T max is less than said predetermined constant Tc3, said time t3 being greater than said time t2.

14. The method of claim 13, wherein if said maximum mold temperature T max is greater than or equal to said predetermined constant Tc3, then delaying said discharge by a time t4, said time t4 being greater than said time t3.

15. The method of claim 9, including the steps of:

determining a mold temperature Tm1;

determining an initial ambient temperature Tr;

comparing said initial ambient temperature Tr with a predetermined constant Ts; and repeating said determining steps and said comparing step if said ambient temperature Tr is greater than said predetermined constant Ts.

16. The method of claim 15, wherein if said ambient temperature Tr is less than or equal to said predetermined constant Ts, then filling said mold cavity with water.

17. The method of claim 16, including the steps of:

determining a mold temperature Tm2;

comparing said mold temperatures Tm1 and Tm2 with a constant Tc1 using the mathematical expression:

$$Tm2-Tm1<Tc1$$

looping back to said first step of determining a maximum mold temperature T max if the difference of Tm2−Tm1 is greater than or equal to said constant Tc1.

18. The method of claim 17, wherein if the difference of Tm2−Tm1 is less than said constant Tc1, then thawing a fill tube used to carry out said filling step.

19. A method of making ice in an automatic ice maker, comprising the steps of:

providing a mold including at least one cavity;

filling said at least one mold cavity at least partially with water;

providing an ice removal device at least partly within said at least one mold cavity wherein said ice removal device comprises an auger;

coupling a mechanical drive with said ice removal device;

coupling a controller with said drive;

measuring a temperature of said mold;

measuring an ambient temperature associated with said mold; and controlling operation of said drive using said controller, dependent upon said measured temperature of said mold and said measured ambient temperature.

* * * * *